US007367557B2

(12) United States Patent
Ito et al.

(10) Patent No.: US 7,367,557 B2
(45) Date of Patent: May 6, 2008

(54) SHEET MATERIAL FEEDING APPARATUS

(75) Inventors: Shinichi Ito, Kawasaki (JP); Naruaki Hiramitsu, Kawasaki (JP); Yoshihiko Naruoka, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 338 days.

(21) Appl. No.: 11/170,800

(22) Filed: Jun. 30, 2005

(65) Prior Publication Data

US 2006/0001208 A1 Jan. 5, 2006

(30) Foreign Application Priority Data

Jul. 1, 2004 (JP) ..... 2004-195777
Mar. 9, 2005 (JP) ..... 2005-065716

(51) Int. Cl.
*B65H 1/02* (2006.01)

(52) U.S. Cl. ..... 271/150; 271/149; 271/2

(58) Field of Classification Search ..... 271/2, 271/149, 150, 166
See application file for complete search history.

(56) References Cited

U.S. PATENT DOCUMENTS 3,178,173 A * 4/1965 Kalman ..... 271/94
5,685,533 A * 11/1997 Hartsoe ..... 271/11
5,934,666 A * 8/1999 Rabindran et al. ..... 271/148
6,217,020 B1 * 4/2001 Supron et al. ..... 271/149

FOREIGN PATENT DOCUMENTS

| | | |
|---|---|---|
| EP | 1 531 137 A1 | 5/2005 |
| JP | 2002-068490 A | 3/2002 |
| JP | 2003-341866 | 12/2003 |
| KR | 2003-0076271 | 9/2003 |
| WO | 97/22425 | 6/1997 |

OTHER PUBLICATIONS

European Search Report dated Aug. 30, 2007 for Appln. No. 05 01 3155.

* cited by examiner

*Primary Examiner*—Patrick Mackey
*Assistant Examiner*—Howard Sanders
(74) *Attorney, Agent, or Firm*—Pillsbury Winthrop Shaw Pittman, LLP

(57) ABSTRACT

A sheet material feeding apparatus includes a feed-out device that brings the stacked sheet materials conveyed on a floor belt into contact with a pickup roller and feeds the sheet materials out in a direction crossing the conveying direction of the stacked sheet materials by rotation of the pickup roller, and an inclination correcting device provided in an upstream of the feed-out device in its sheet material feeding direction and including an upper roller located at a position higher than that of the pickup roller, that brings an upper side of the stacked sheet materials conveyed towards the feed-out device into contact with the upper roller to correct the inclination of the stacked sheet materials.

7 Claims, 6 Drawing Sheets

SHEET MATERIAL FEEDING APPARATUS

CROSS-REFERENCE TO RELATED APPLICATIONS

This application is based upon and claims the benefit of priority from prior Japanese Patent Applications No. 2004-195777, filed Jul. 1, 2004; and No. 2005-065716, filed Mar. 9, 2005, the entire contents of both of which are incorporated herein by reference.

BACKGROUND OF THE INVENTION

1. Field of the Invention

The present invention relates to a sheet material feeding apparatus that feeds a sheet material such as a postal matter.

2. Description of the Related Art

As a sheet material feeding apparatus of this kind, there is known a type in which sheet materials are placed in a standing position on a floor belt and they are conveyed to a feed-out unit as the floor belt runs. At the feed-out unit, sheet materials are fed out one by one as feed-out roller or feed-out belt rotates.

However, in some cases, stacked sheet materials are conveyed in an inclined state as relative to the feed-out unit as being affected so for one reason or another or the stacked sheet materials are already set in an inclined state on the floor belt before they are conveyed. In such cases, the sheet materials are not evenly brought into contact with the feed-out roller or feed-out belt, and thus an uneven contacting state is created. When the sheet materials are fed out in this state, such problems occur that sheets are skewed and continuous feeding out of sheets is interrupted.

As a solution to this, such a conventional technique was developed as disclosed in, for example, Jpn. Pat. Appln. KOKAI Publication No. 2002-68490, in which the floor belt is divided and a lever is provided to convey sheet materials while detecting the clearance between sheet materials (, which is roughly equivalent to the inclining state), to realize stable feeding out of the materials.

However, with the above-described method, a mechanism for operating the lever is necessary, which makes the structure of the device complicated, and there is such a drawback that sheet material may be damaged when the lever fails to function properly.

BRIEF SUMMARY OF THE INVENTION

The present invention has been proposed in consideration of the above-described circumstances of the conventional technique and its object is to provide a sheet material feeding apparatus with a simple structure, which can correct the inclination of stacked sheet materials without the possibility of damaging any of the materials.

According to an aspect of the present invention, there is provided a sheet material feeding apparatus comprising: a conveying device that conveys stacked sheet materials in a stacking direction in a standing state; a feed-out device that brings the stacked sheet materials conveyed by the conveying device into contact with a feed-out roller and feeds the sheet materials out in a direction crossing the conveying direction of the stacked sheet materials by rotation of the feed-out roller; a guide unit that guides the sheet materials fed out by the feed-out device along a guide surface such as to project a part of the feed-out roller from the guide surface; and an inclination correcting device provided in an upstream of the feed-out device in its sheet material feeding direction and including a roller member located at a position higher than that of the feed-out roller, that brings an upper side of the stacked sheet materials conveyed towards the feed-out device into contact with the roller member to correct the inclination of the stacked sheet materials.

According to the above-described embodiment of the present invention, the inclination of stacked sheet materials can be corrected merely by bringing the sheet materials into contact with the roller member of the inclination correcting device. Thus, the invention has a simple structure and does not damage sheet materials. Further, the sheet materials are handled to displaced from each other to be fed out, and thus they can be separated surely one by one.

Additional objects and advantages of the invention will be set forth in the description which follows, and in part will be obvious from the description, or may be leaned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of the present invention will now be described in detail with reference to accompanying drawings.

Figure 1:
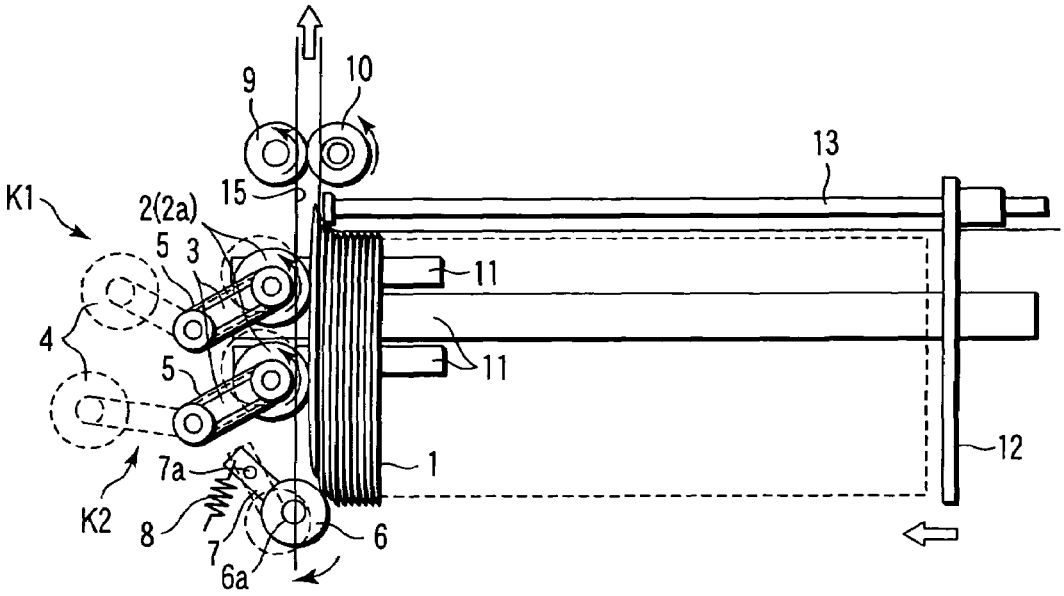
FIG. 1 is a plan view showing a sheet material feeding apparatus according to the first embodiment of the present invention.

FIG. 1 is a plan view schematically showing the structure of a sheet material feeding apparatus according to the first embodiment of the present invention.

This sheet material feeding apparatus includes a floor belt 11 serving as a conveying device that conveys stacked sheet materials 1 placed thereon in a standing position. A rear end side of the stacked sheet materials 1 with respect to the direction of the materials being conveyed by the floor belt 11 is held with a pressure by a backup plate 12. The backup plate 12 is moved along a backup plate shaft 13.

In the downstream of the conveying direction of the stacked sheet materials 1, the first and second feeding mechanisms K1 and K2 are provided as a feed-out device. Sheet materials are fed by the first and second feeding mechanisms K1 and K2 in a direction that crosses the direction of conveying the stack sheet materials 1. Further, a guide plate 15 serving as a guide member is provided along the direction of feeding sheet materials, and while conveying the sheet materials, they are guided along a guide surface 15*a* of the guide plate 15.

The first feeding mechanism K1 includes upper and lower pick-up rollers 2*a* and 2*b* and these pick-up rollers 2*a* and 2*b* are each supported by a pick-up arm 3. A drive motor 4 is connected to the pick-up roller 2 via a timing belt 5. The second feeding mechanism K2 has a similar structure to that of the first feeding mechanism 1, and therefore similar parts are designated by the same reference symbols and the explanations therefor will be omitted.

In the upstream of the sheet material feeding direction of the second feeding mechanism K2, an inclination correcting mechanism 6 is provided as an inclination correcting device to correct the inclination of the stacked sheet materials 1, which will be described in detail later.

The inclination correcting mechanism 6 is rotatably supported by one end of a support arm 7 serving as a support device. The support arm 7 is pivotably supported on a pivot 7*a* by its middle portion and the other end thereof is urged by a spring member 8. With the urging force of the spring member 8, the inclination correcting mechanism 6 is brought into contact with a pressure on the upper side of the rear end side of the stacked sheet materials in the feeding direction.

In the feeding direction of sheet materials, a feed roller 9 is provided to feed sheet materials to the downstream, and a reverse roller 10 is provided for the feed roller 9 in order to separate materials from the next sheet on by applying a counter-rotating torque thereto.

Figure 2:
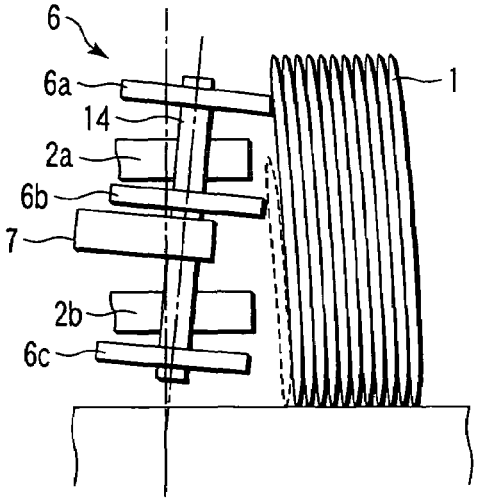
FIG. 2 is a front view showing a mechanism of correcting inclination of stacked sheet materials in the sheet material feeding apparatus.

FIG. 2 is a front view showing the inclination correcting mechanism 6 described above.

The inclination correcting mechanism 6 includes a support shaft 14. An upper roller 6*a* serving as an upper end roller member is provided on an upper end portion of the support shaft 14, a middle roller 6*b* is mounted in a middle portion thereof, and a lower roller 6*c* is mounted in a lower portion thereof. The support shaft 14 is inclined to make a predetermined angle with respect to the normal line. In other words, the support shaft 14 is inclined such that the upper end side thereof is set close to the stacked sheet materials 1, whereas the lower end side is distant from the stacked sheet materials 1. The rollers 6*a* to 6*c* are arranged to be in parallel with each other, and they all have the same diameter.

The inclining angle of the support shaft 14 is set to 4°, and the heights of the rollers 6*a* to 6*c*, that is, the height to a corner portion that is brought into contact with sheet materials in each, are 140 mm for the upper roller 9*a*, 90 mm for the middle roller 6*b* and 20 mm for the lower roller 6*c*.

The amount of projection of the upper roller 6*a* and middle roller 6*b* from the guide plate 15 is set a predetermined amount larger than the projecting amount of the pickup roller 2 from the guide plate 15. With this arrangement, as stacked sheet materials becomes higher and more easily inclined, the inclination of the stack is more corrected as the stack abuts against the rollers of the upper side.

It should be noted here that if the lower roller 6*c* is set to project in a similar manner to those of the rollers 6*a* and 6*b* on the upper side, such an arrangement in some cases prevent stacked sheet materials from being brought into contact with the lower pickup roller 2*b*. In order to avoid this, the projecting amount of the lower roller 6*c* is set smaller than the projecting amount of the lower pickup roller 2*b*.

Next, the feeding operation of the sheet material feeding apparatus will now be described.

First, the stacked sheet materials 1 are set in a standing position on the floor belt 11, and then the floor belt 11 and backup plate 12 are moved in the direction indicated in FIG. 1 to convey the stacked sheet materials 1. While this operation, if the stacked sheet materials 1 are conveyed in an inclined state, for example, while being inclined such that the upper side of the stack is close to the pickup roller 2*b*, whereas the lower side thereof is distant from the pickup roller 2*b*, as shown in FIG. 2, the upper side of the stack of the sheet materials 1 is brought into contact with a pressure with the upper roller 6*a* so that the upper side is pushed back. In this manner, the inclination of the stacked sheet materials 1 is corrected so that they stand straight up. After the inclination is corrected as described, the stacked sheet materials 1 are set to abut against the pickup rollers 2*a* and 2*b*. Sheet materials abutting against the pickup rollers 2*a* and 2*b* are fed to the feed roller 9 as the pickup rollers 2*a* and 2*b* rotate. While this operation, the rollers 6*a* and 6*b* are rotated to follow the rotation of the pickup rollers 2*a* and 2*b* via a respective sheet material, thereby making it possible to reduce the load during the feeding. The fed sheet materials are separated one by one from each other by the rotations of the feed roller 9 and reverse roller 10, and they are conveyed to the downstream as indicated by a white arrow in FIG. 1.

Figure 3:
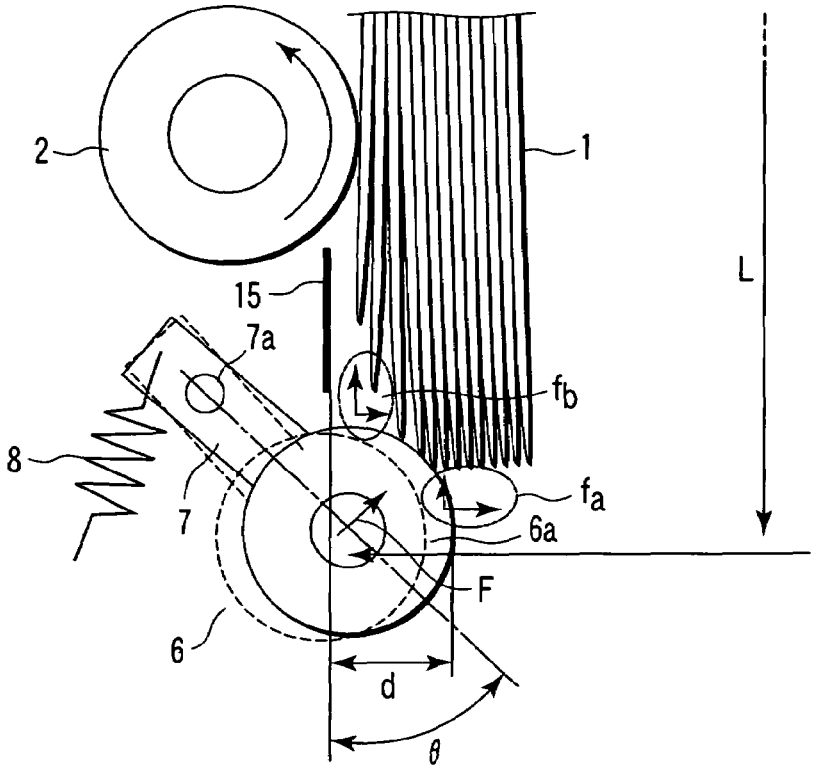
FIG. 3 is a diagram showing a force applied to stacked sheet materials by the inclination correcting mechanism.

FIG. 3 illustrates the details of the operation of the upper roller 6*a* of the inclination correcting mechanism 6.

Due to the urging force of the spring member 8, there is created a force applied to the upper roller 6*a* to move in the directed indicated by arrow F. The upper side of the rear end of the stacked sheet materials 1 is pushed against the upper roller 6*a*. Here, the direction of the force propagated to the stacked sheet materials 1 changes depending upon with which part of the upper roller 6*a* the stacked sheet materials 1 are brought into contact. More specifically, at a position fa which corresponds to a relatively beginning stage where the stack of sheet materials 1 are brought into contact with the upper roller 6*a*, the component of the force that acts in the stacking direction of the sheet materials is larger than the component of the force that acts in the planer direction of the sheet materials. On the other hand, at a position fb which corresponds to a relatively ending stage of the contact between the stack of sheet materials 1 and the upper roller 6*a*, the component of the force that acts in the planer direction of the sheet materials is larger than the component of the force that acts in the stacking direction of the sheet materials.

It should be noted here that the component of the force that acts in the stacking direction of the sheet materials serves as a force to support the sheet materials being conveyed in the inclined state, whereas the component of the force that acts in the planer direction of the sheet materials serves as a force to feed the sheet materials.

Therefore, the stacked sheet materials 1 are shifted from the beginning state where they are pushed in the direction of correcting its inclination to the state where they are fed in the feeding direction. This transition of the state is very convenient to maintain the continuous sheet material feeding operation.

Further, as the component of the force applied on the stacked sheet materials 1 shifts its direction, such an effect of separating the stacked sheet materials from each other, which is so called "handling effect", is obtained. Thus, the load resistance due to the tightly stacking of the sheet materials, can be reduced.

As described, due to the effect obtained by the arrangement of the inclination correcting mechanism 6, a stable feeding out operation can be carried out even if stacked sheet materials, for example, fall.

In this embodiment, the outer diameter of the upper roller 6*a* is set to ϕ40 mm, the radius of pivoting is set to 40 mm, and the projecting amount from the guiding plate 15 is set to 20 mm±2 mm.

Further, the pivotable range θ of the upper roller 6*a* is set to 35° to 65°, and the value of F is set to 7.2N (0.8 kgf) to 14.7N (1.5 kgf), which is set by arranging the spring member 8 appropriately and selecting an appropriate spring constant.

Under the above-described conditions, sample envelopes were prepared and a continuous feeding test was carried out.

The sample envelopes were those of a size C5 (229 mm×162 mm), and different contents were enclosed in the envelopes, with such an adjustment of the ratio in the number of envelopes so that the weights of the envelope vary from 10 g to 50 g, at an average of 25 g.

When the apparatus was operated with a control order of feeding the sheet materials at a conveying speed of 3.6 m/s and a constant gap of 100 mm (, which is equivalent to 38.2 k envelopes/h), it was possible to stably and continuously carry out the feeding out operation at an average gap of 109.4 mm and an accuracy of a standard deviation of 10 mm.

Further, since the upper roller 6*a* was set swingable, and therefore a similar effect to the above can be obtained regardless of the length of the sheet materials as long as it is within the swinging range.

Actually, the length of the sheet materials was varied from 220 mm to 250 mm and the test was carried out. In each case, it was possible to stably and continuously carry out the feeding out operations at an average gap of 108 to 112 mm and an accuracy of a standard deviation of 6 to 10 mm.

This embodiment is appropriate for such usage that sheet materials of a length from 220 mm to 250 mm are handled, and it is a feeding out apparatus with an excellent performance in handling, mainly, envelops of the size C5.

Here, for sheet materials of a length of less than 220 mm, it is possible to feed out them stably by means of the feeding out force of the pickup roller 2 itself even without the upper roller 6*a*. Therefore, it is sufficiently possible to handle sheet materials of shorter lengths.

Further, in this embodiment, the upper, middle and lower rollers 6*a* to 6*c* are fixed onto the common arm 7 by the shaft 14, but it is alternatively and perfectly possible to prepare separate arms for the respective rollers in an independent suspension structure.

Figure 4:
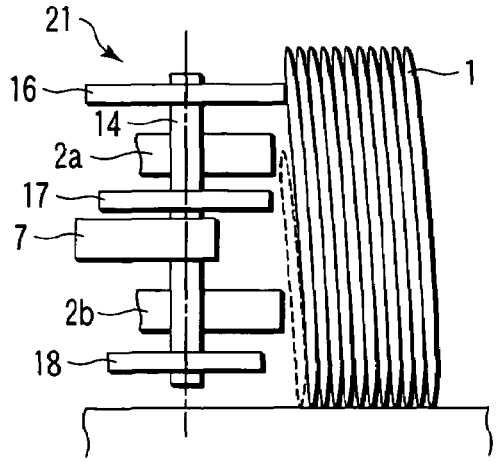
FIG. 4 is a front view showing an inclination correcting mechanism according to the second embodiment of the present invention.

FIG. 4 is a front view showing an inclination correcting mechanism 21 according to the second embodiment of the present invention.

In the second embodiment, the inclination correcting mechanism 21 is provided vertically without being inclined. That is, the support shaft 14 is provided vertically, and an upper roller having a large diameter, a middle roller 17 having a middle diameter and a lower roller 18 having a small diameter are mounted on the support shaft 14 horizontally at predetermined intervals.

With this structure, as the stacked sheet materials become higher and more easily inclined, they abut more against the upper roller for a better support.

Similar tests to those of the first embodiment were conducted under such conditions that the diameters of the upper roller 16, middle roller 17 and lower roller 18 were set to ϕ56 mm, ϕ50 mm, and ϕ40 mm, it was possible to stably and continuously carry out the feeding out operations on sheet materials of a length of 220 mm to 250 mm at an average gap of 109 mm to 112 mm and an accuracy of a standard deviation of 7 to 11.

As described above, it is not necessary to incline the whole inclination correcting mechanism, but a similar effect to that of the first embodiment can be obtained by setting the different diameters for the rollers 16 to 18.

It should be pointed out that as described in connection with the first and second embodiments, the effect of the present invention can be best obtained by arranging the inclination correcting mechanisms 6 and 21 to match the length of sheet materials that are handled mostly. When the length of sheet materials to be handled varies, it is natural to change the arrangement to obtain a similar effect to that.

Figure 5:
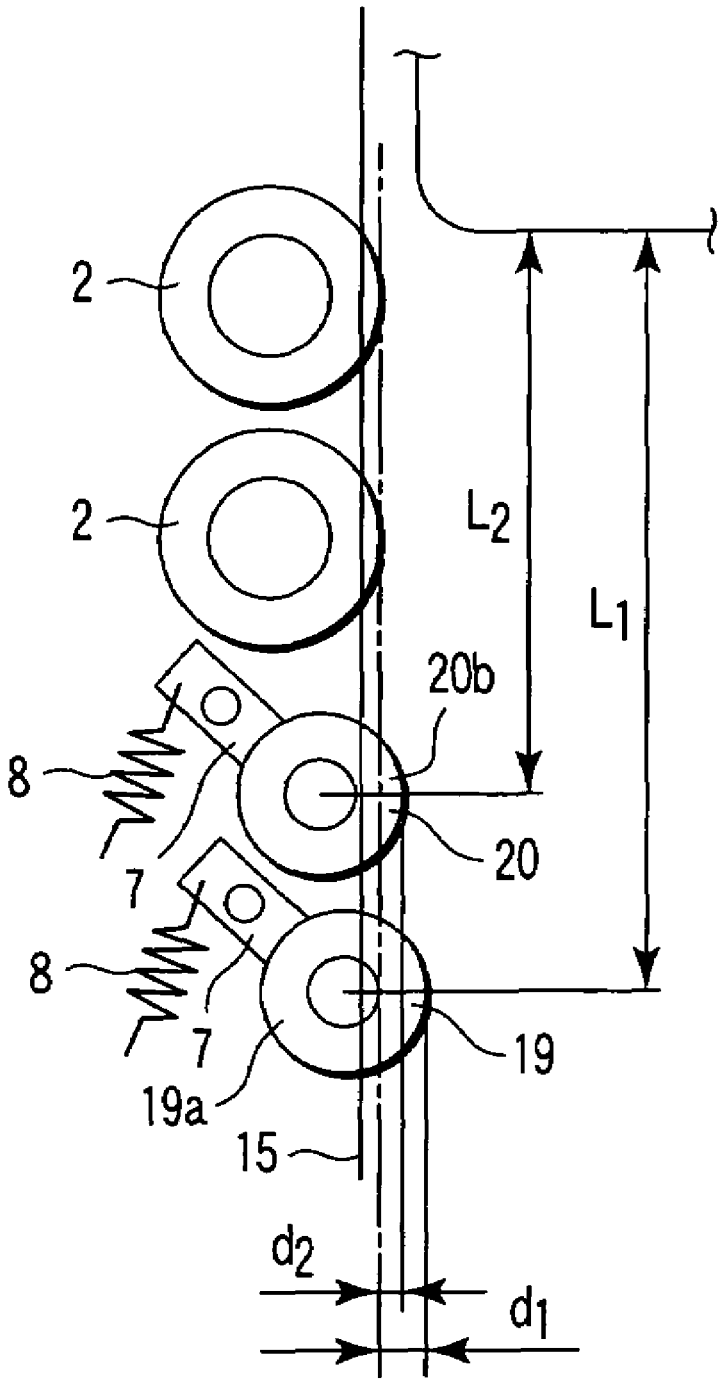
FIG. 5 is a plan view showing a set of inclination correcting mechanisms according to the third embodiment of the present invention.

FIG. 5 is a plan view showing first and second inclination correcting mechanisms 19 and 20 according to the third embodiment of the present invention.

In this embodiment, the first and second inclination correcting mechanisms 19 and 20 are provided in a multiple arrangement along the feeing out direction of sheet materials. With this arrangement, the apparatus becomes able to deal with such a situation that sheet materials with different lengths are handled at the same time.

In the case where the first and second inclination correcting mechanisms 19 and 20 are arranged in a multiple manner, it is necessary to clear the condition that the first inclination correcting mechanisms 19, which is located on the upstream side in the sheet material feeding direction, must be placed such that the projecting amount of the first inclination correcting mechanisms 19 from the guide plate 15 is larger than that of the second inclination correcting mechanism 20, which is located on the downstream side.

The first inclination correcting mechanisms 19 is designed to support sheet materials with relatively large sizes, whereas the second inclination correcting mechanism 20 is designed to support sheet materials with relatively small sizes.

Each of the first and second inclination correcting mechanisms 19 and 20 is set at an inclining angle of 4° as in the case of the first embodiment. For the first inclination correcting mechanisms 19, there are three rollers, that is, the upper, middle and lower ones are provided, whereas for the second inclination correcting mechanisms 20, there are two rollers, that is, the middle and lower ones, without the upper one, are provided.

The projecting amount of the first inclination correcting mechanism 19 from the guiding plate 15 is set larger by d1 (10 mm) as compared to the projecting amount of the pickup roller 2 from the guiding plate 15, and a distance L1 from a central portion of the upper roller 19*a* to the leading end surface of the sheet materials is 238 mm.

Further, the projecting amount of the second inclination correcting mechanism 20 from the guiding plate 15 is set larger by d2 (4 mm) as compared to the projecting amount of the pickup roller 2 from the guiding plate 15, and a distance L2 from a central portion of the middle roller 20*a* to the leading end surface of the sheet materials is 218 mm.

The arrangement of the first inclination correcting mechanism 19 is based on a case were large-sized post cards having a length of about 210 mm (widely popular in, for example, Europe) are handled.

The reason why the projecting amount of the first inclination correcting mechanism 19 is set larger that of the second inclination correcting mechanism 20 is to prevent the second inclination correcting mechanism 20 from being brought into contact with a middle portion of a sheet material, especially, when the sheet material is of a larger size, which creates a loading resistance when feeding out sheet materials.

Further, the second inclination correcting mechanism 20 is designed for sheet materials having relatively short lengths. In many cases, sheet materials of short lengths do not have such heights for their lengths, and therefore the inclination correcting amount for a stack of such sheet materials may be less to be sufficient. Therefore, it is not necessary to set a large projecting amount for this mechanism.

With the above-described arrangement, the length of the sheet materials was varied from 160 mm to 250 mm and the test was carried out. In each case, it was possible to stably and continuously carry out the feeding out operations at an average gap of 110 to 120 mm and an accuracy of a standard deviation of 8 to 13 in each case.

Figure 6:
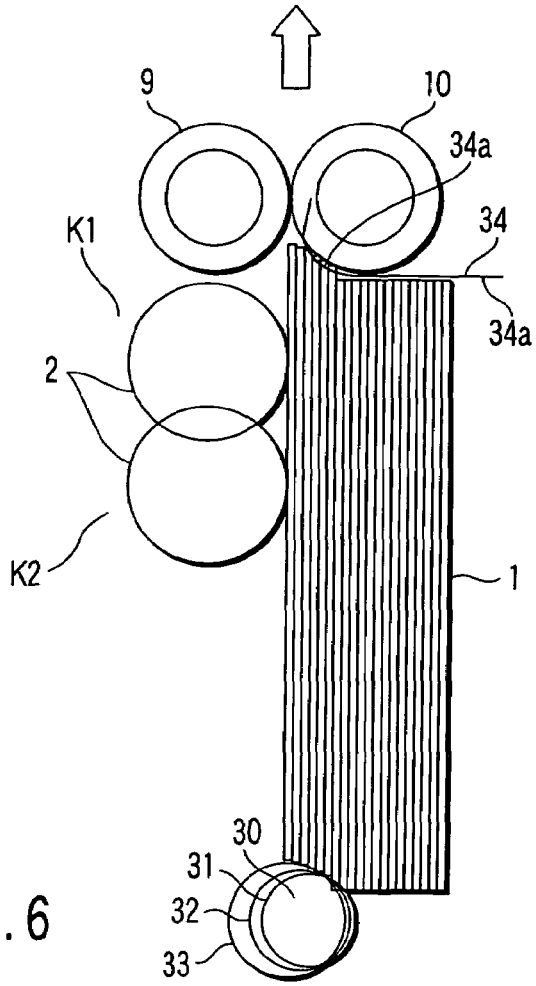
FIG. 6 is a plan view showing an inclination correcting mechanism according to the fourth embodiment of the present invention.
Figure 7:
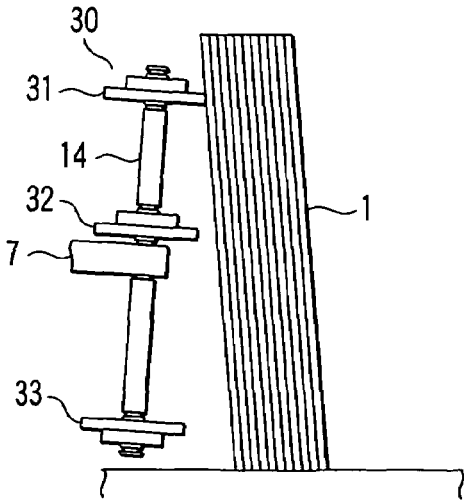
FIG. 7 is a front view of the inclination correcting mechanism shown in FIG. 6.

FIG. 6 is a plan view showing an inclination correcting mechanism 30 according to the fourth embodiment of the present invention, and FIG. 7 shows its front view.

As in the case of the inclination correcting mechanism 6 shown in FIG. 2, the inclination correcting mechanisms 30 of this embodiment includes a support shaft 14, to which an upper roller 31 serving as the first roller, a middle roller 32 and a lower roller 33 serving as the second roller are mounted at an upper end portion, middle portion and lower portion thereof.

The upper, middle and lower rollers 31 to 33 are arranged to be in parallel with each other, and the sizes of their diameters have the relationship of the upper roller 31<the middle roller 32<the lower roller 33. In more specific, the outer diameter of the upper roller 31 is ϕ34 mm, the outer diameter of the middle roller 32 is ϕ37 mm and the outer diameter of the lower roller 33 is ϕ43 mm.

The heights of the upper, middle and lower rollers 31 to 33, that is, the heights taken at corner portions that are brought into contact with the sheet materials, are set to 140 mm, 90 mm and 20 mm, respectively.

The radius of pivoting of the support arm 7 is set to 40 mm, and the projecting amount d of each of the upper, middle and lower rollers 31 to 33 from the guide plate 15 is set to 20 mm±2 mm.

The distance L from an evening surface 34 of the guide plate 34, which evens the edges of the sheet materials, to the center of the support shaft 14 is set to 241 mm±2 mm. The radius of an R section 34*b* of the guide member 34 serving to guide the leading edges of the stacked sheet materials 1 between a feed roller 9 and a reverse roller 10 is set to 22 mm.

The radius of the lower roller 33 is set substantially equal to the radium of the R section 34*b* of the guide plate 34.

The inclination correcting mechanism 30 having the above-described structure was subjected to feeding tests, in which sheet materials of sample envelopes of a size C5 (229 mm×162 mm), which is most popularly used outside Japan for the usage of direct mails in particular, are continuously fed.

That is, if the stacked sheet materials 1 are conveyed in an inclined state as shown in FIG. 7, the upper side of the stack of the sheet materials 1 is brought into contact with a pressure with the upper roller 31 and middle roller 32 so that the upper side is pushed back. In this manner, the inclination of the stacked sheet materials 1 is corrected so that they stand straight up.

During the correction of the inclination, a component of the force that acts in the stacking direction of the sheet materials, and a component of the force that acts in the planer direction of the sheet materials are created. The component that acts in the stacking direction of the sheet materials serves as a force to support the sheet materials being conveyed in the inclined state, whereas the component that acts in the planer direction serves as a force to feed the sheet materials.

Then, as the component of the force applied on the stacked sheet materials 1 shifts from the stacking direction to the planer direction, such an effect of separating the stacked sheet materials from each other, which is so called "handling effect", is obtained.

In this embodiment, the outer diameter of the lower roller 33 is set larger than that of the upper roller 31, and substantially equal to the radius of the R section of the guide plate 34. With this structure, the lower roller 33 can apply the feeding force to the sheet materials, and therefore the sheet materials that have been in tight contact with each other can be separated from each other and such a displaced state can be maintained. Thus, the sheet materials can be allowed to enter between the feed roller 9 and reverse roller 10 while being displaced from each other, thereby making it possible to surely separate the sheet materials from each other.

It should be noted here that in the case where the outer diameter of the upper roller 31 is made larger to be equal to that of the lower roller 33, the phase between the outer diameter of the upper roller 31 and the R section 34*b* of the guide plate 34 is shifted. More specifically, the distance between the upper roller 31 and the guide plate 34 becomes smaller than 229 mm, which is a length of a C5 size. With this arrangement, the rear end of a sheet material in its feeding-out direction may be caught in the upper roller 31, thereby failing to set displacement between the sheet materials by the upper roller 31. In this case, the sheet materials enters the pressure contact portion between the feed roller 9 and reverse roller 10 without having a displacement of edges between sheet materials, and therefore the frequency of feeding two or more sheet materials in stack erroneously without being separated from each other is increased.

Figure 8:
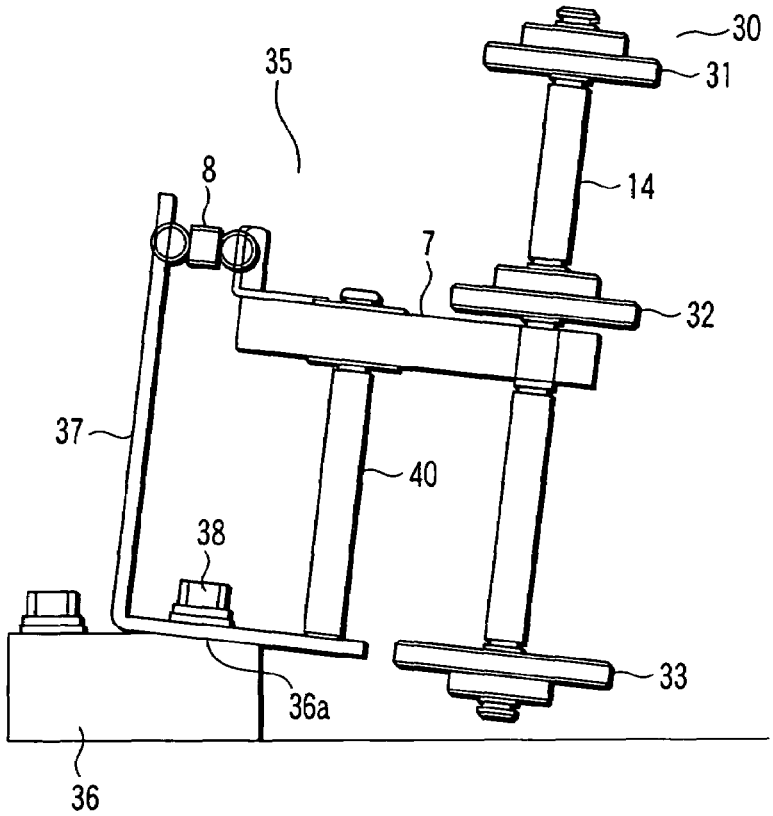
FIG. 8 is a front view showing a moving mechanism of the inclination correcting mechanism shown in FIG. 6.
Figure 9:
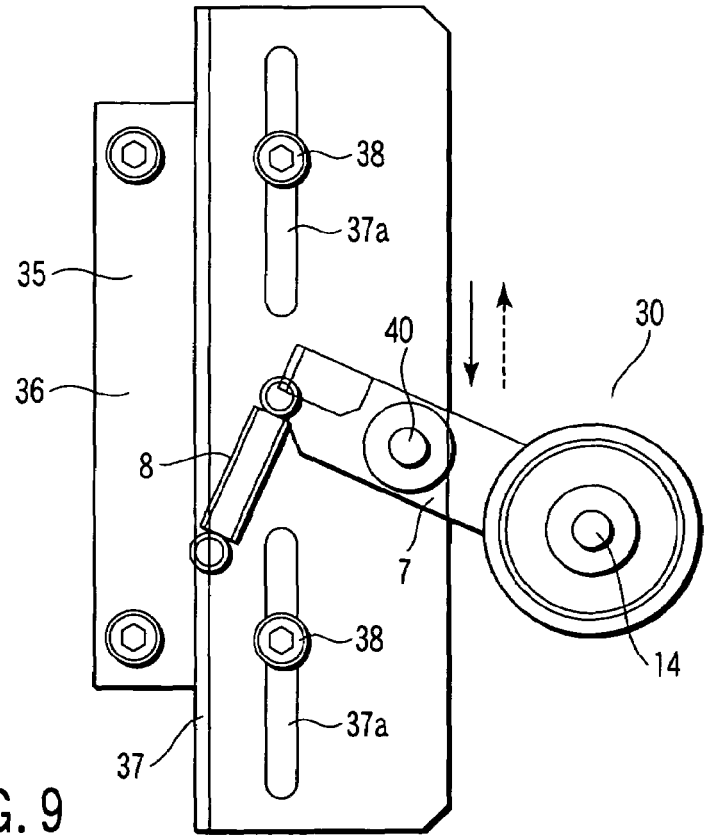
FIG. 9 is a plan view of moving mechanism shown in FIG. 8.

FIG. 8 is a front view showing a support mechanism 35 of the inclination correcting mechanism described above, and FIG. 9 is a plan view of the support mechanism.

The figure shows a substrate 36, a mount surface 36*a* is formed on its upper surface portion to be inclined. A support bracket 37 having a cross section of an L shape is mounted with a bolt 38 on the mount surface 36*a* of the substrate 36. elongated holes 37*a* are made in a bottom surface portion of the support bracket 37 along the direction of feeding the sheet materials. The support bracket 37 is fixed with bolts 38 inserted to the elongated holes 37*a* and 37*b*. As the bolts 38 are loosened, the support bracket 37 is slid to move in the longitudinal direction of the elongated holes 37*a*.

A shaft 40 is provided to stand at a central portion of a bottom surface of the support bracket 37, and a middle portion of the pivot arm 7 is pivotably mounted to the upper end portion of the shaft 40. The support shaft 14 is mounted to one end of the pivot arm 7, and upper, middle and lower rollers 31 to 33 are mounted to the support shaft 14. The other end of the pivot arm 7 is connected to the support bracket 37 via a spring member 8.

The inclination correcting mechanism 30 supported as above is moved to change its position in accordance with the size of sheet materials to be fed.

For example, in the case where sheet materials of a large size are to be fed, the bolts 38 are loosened and the support bracket 37 is slid to move as indicated by an arrow of a solid line to increase the distance between the rollers 31 to 33 and the guide plate 34. Then, the bolts 38 are tightened to fix the support bracket 37. On the other hand, in the case where sheet materials of a small size are to be fed, the support bracket 37 is slid to move as indicated by an arrow of a broken line to decrease the distance between the rollers 31 to 33 and the guide plate 34.

Figure 10:
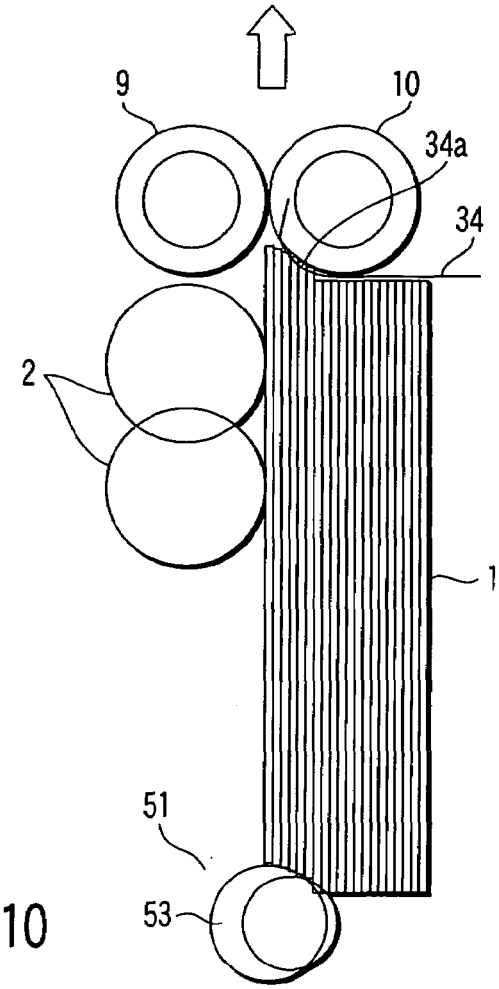
FIG. 10 is a plan view showing an inclination correcting mechanism according to the fifth embodiment of the present invention.
Figure 11:
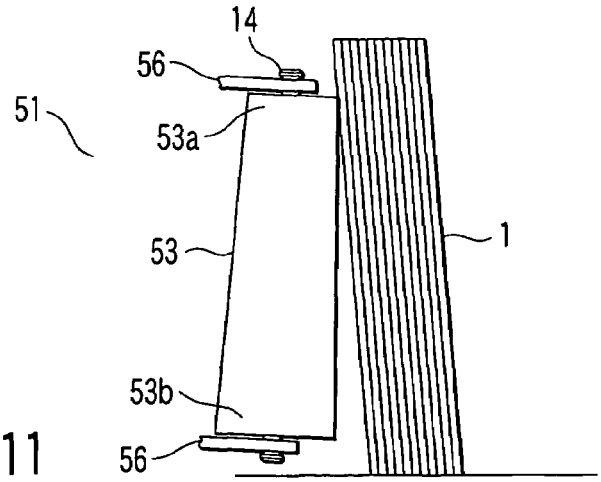
FIG. 11 is a front view of the inclination correcting mechanism shown in FIG. 10.

FIG. 10 is a plan view showing an inclination correcting mechanism 51 according to the fifth embodiment of the present invention, and FIG. 11 is a front view thereof.

The inclination correcting mechanism 51 includes an inclined support shaft 14 as in the case of the inclination correcting mechanism 30 described above, and a cylindrical roller member 53 is rotatably mounted to the support shaft 14. The roller member 53 is formed such that the diameter thereof gradually decreases from its lower end portion to the upper end portion. The upper and lower portions of the support shaft 14 are supported by pivot arms 56.

An upper side 53*a* of the roller member 53 is located at a level higher than that of a pickup roller 2*a*, and the radium of a lower side 53*b* is set substantially equal to the radius of an R section 34*b* of a guide plate 34.

In the inclination correcting mechanism 51 having the above-described structure, if the stacked sheet materials 1 are conveyed in an inclined state as shown in FIG. 11, and the upper side of the stack of the sheet materials 1 is brought into contact with a pressure with the upper side of the roller member 53, the upper side is pushed back. In this manner, the inclination of the stacked sheet materials 1 is corrected so that they stand straight up.

During the correction of the inclination, the stacked sheet materials can be handled to displace from each other as in the case of the inclination correcting mechanism 30. Thus, the sheet materials can be allowed to enter between the feed roller 9 and reverse roller 10 while being displaced from each other, thereby making it possible to surely separate the sheet materials from each other.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A sheet material feeding apparatus comprising:

a conveying device that conveys stacked sheet materials in a stacking direction in a standing state;

a feed-out device that brings a feed-out roller into contact with a face of the stacked sheet materials conveyed by the conveying device and feeds the sheet materials out in a direction crossing the conveying direction of the stacked sheet materials by rotation of the feed-out roller;

a guide unit that guides the sheet materials fed out by the feed-out device along a guide surface such as to project a part of the feed-out roller from the guide surface; and an inclination correcting device, provided upstream of the feed-out device in its sheet material feeding direction, that includes a roller member located at a position higher than that of the feed-out roller in order to bring an upper side of the stacked sheet materials conveyed towards the feed-out device into contact with the roller member to correct the inclination of the stacked sheet materials, wherein the inclination correcting device includes a support shaft inclined to make a predetermined angle with respect to a normal line such that an upper end of the support shaft is at a closer distance to the stacked sheet materials whereas a lower end of the support shaft is more distant to the stacked sheet materials, the support shaft configured to support the roller member and to further support a plurality of roller members having a same diameter as that of the roller member, located in a lower side of the roller member and arranged in parallel with each other at predetermined intervals, and the roller member on the upper side being arranged to project much further from the guide unit than the feed-out roller.

2. The sheet material feeding apparatus according to claim 1, wherein the inclination correcting device includes a vertical support shaft, the support shaft supporting the roller member and further supporting a plurality of roller members having diameters different from each other, located in a lower side of the roller member and arranged in parallel with each other at predetermined intervals, and the roller member on the upper side projects much further from the guide unit than the feed-out roller.

3. The sheet material feeding apparatus according to claim 1, wherein the roller members of the inclination correcting device brought into contact with the stacked sheet materials are rotated to follow the rotation of the feed-out roller via sheet materials being fed out.

4. The sheet material feeding apparatus according to claim 1, further comprising: a support device that elastically urges the roller member of the inclination correcting device towards the stacked sheet materials, and moves against the urging force as the stacked sheet materials are brought into contact with the roller member.

5. A sheet material feeding apparatus comprising:

a conveying device that conveys stacked sheet materials in a stacking direction in a standing state;

a feed-out device that brings a feed-out roller into contact with a face of the stacked sheet materials conveyed by the conveying device and feeds the sheet materials out in a direction crossing the conveying direction of the stacked sheet materials by rotation of the feed-out roller;

a guide unit that guides the sheet materials fed out by the feed-out device along a guide surface such as to project a part of the feed-out roller from the guide surface; and an inclination correcting device provided upstream of the feed-out device in its sheet material feeding direction and includes a support shaft inclined to make a predetermined angle with respect to a normal line such that an upper end of the support shaft is at a closer distance to the stacked sheet materials whereas a lower end of the support shaft is more distant to the stacked sheet materials, a first roller member located at a position higher than that of the feed-out roller, and supported on the support shaft such that a projecting amount from the guide unit is larger than a projecting amount of the feed-out roller, and a second roller member located on a lower side of the first roller member and having an outer diameter larger than that of the first roller, that brings an upper side of the stacked sheet materials conveyed towards the feed-out device into contact with the first roller member to correct the inclination of the stacked sheet materials.

6. The sheet material feeding apparatus according to claim 5, further comprising: a support device that supports the inclination correcting device to be movable in a direction normal to the conveying direction of the stacked sheet materials.

7. A sheet material feeding apparatus comprising:

a conveying device that conveys stacked sheet materials in a stacking direction in a standing state;

a feed-out device that brings a feed-out roller into contact with a face of the stacked sheet materials conveyed by the conveying device and feeds the sheet materials out in a direction crossing the conveying direction of the stacked sheet materials by rotation of the feed-out roller;

a guide unit that guides the sheet materials fed out by the feed-out device along a guide surface such as to project a part of the feed-out roller from the guide surface; and an inclination correcting device provided upstream of the feed-out device in its sheet material feeding direction and includes a cylindrical roller member inclined to make a predetermined angle with respect to a normal line such that an upper end of the cylindrical roller member is at a closer distance to the stacked sheet materials whereas a lower end of the cylindrical roller member is more distant to the stacked sheet materials, and having such a shape that a diameter thereof gradually decreases from a lower side towards an upper side, the upper side of the roller member being located at a position higher than that of the feed-out roller, and having a projecting amount from the guide unit larger than a projecting amount of the feed-out roller, the inclination correcting device bringing an upper side of the stacked sheet materials conveyed towards the feed-out device into contact with the upper side of the roller member to correct the inclination of the stacked sheet materials.

* * * * *